United States Patent [19]

Sato

[11] Patent Number: 4,699,685

[45] Date of Patent: Oct. 13, 1987

[54] MANUALLY-OPERATED LABELER

[75] Inventor: Junichi Sato, Tokyo, Japan

[73] Assignee: Kabushiki Kaisha Shinsei Industries, Tokyo, Japan

[21] Appl. No.: 822,614

[22] Filed: Jan. 27, 1986

[30] Foreign Application Priority Data

Jan. 30, 1985 [JP] Japan ..... 60-11614[U]

[51] Int. Cl.[4] ..... B65C 11/02

[52] U.S. Cl. ..... 156/384; 101/288; 156/577; 156/579; 156/584; 156/DIG. 49

[58] Field of Search ..... 156/384, 577, 579, 584, 156/DIG. 48, DIG. 49; 101/288

[56] References Cited

U.S. PATENT DOCUMENTS

| | | | |
|---|---|---|---|
| 3,156,603 | 11/1964 | Robinson | 156/577 |
| 3,231,446 | 1/1966 | Satas | 156/384 |
| 3,265,553 | 8/1966 | Kind et al. | 156/384 |
| 4,041,863 | 8/1977 | Mullen et al. | 101/288 |
| 4,188,255 | 2/1980 | Gottardo | 156/577 |
| 4,301,729 | 11/1981 | Fujita | 156/384 |
| 4,406,727 | 9/1983 | Fujita | 156/384 |

*Primary Examiner*—Michael Wityshyn

*Attorney, Agent, or Firm*—Wenderoth, Lind & Ponack

[57] ABSTRACT

A manually-operated labeler has a casing provided with a tape holder for holding a roll-shaped label tape consisting of a carrier strip and a number of labels which are consecutively stuck onto the carrier strip and with a handle, a drive mechanism provided with a lever which is manually operated and an operating part extending inside the casing operated by the lever, a feed drum which is manually operated and an operating part extending inside the casing operated by the lever, a feed drum which is intermittently driven by the drive mechanism and thus feeds a specified length of the carrier strip of the label tape, a bottom cover pivoted to the casing to form a bottom of the casing and which adapted to turn back said carrier strip, and a carrier strip feed-out mechanism for feeding out the carrier strip from the casing in cooperation with said feed drum, and a notched slit provided in a side wall of the casing to separate the side wall along a line extending from the tape holder to the bottom side, such that said feed drum is opposed to an impression member by which the label tape is depressed against the bottom cover to be stationary while it is not fed by the feed drum.

15 Claims, 5 Drawing Figures

MANUALLY-OPERATED LABELER

BACKGROUND OF THE INVENTION

1. Field of the Invention

The present invention relates to a manually-operated labeler for intermittently feeding a label tape consisting of a carrier strip and a number of labels which are consecutively stuck to said carrier strip and for separating a label from the carrier strip and forwarding it along with movement of the carrier strip by turning back the carrier strip at a carrier strip turnback part.

2. Description of the Prior Art

This type of labeler as described in the Specifications of U.S. Pat. Nos. 4,301,729 and 4,406,727 is adapted so that a roll-shaped label tape is held on the tape holder provided on the casing, said label tape extending from its free end into the feed passage, turned back at the carrier strip turnback part in the feed passage and engaged with the feed drum after having been turned back, and said feed drum is intermittently rotated by operating the manual lever to feed the label tape when this labeler is used. Generally, the labeler incorporates the printer unit for printing on a label before separating it from the carrier strip.

Conventional types of labelers are disadvantageous in that it is necessary to extend the carrier strip in the feed passage by pulling the label tape and to engage the carrier strip with the feed drum. Therefore it is troublesome to pass the label tape inside the casing and extend it into the feed passage and the label tape may not be smoothly moved in some cases.

An object of the present invention is to provide a labeler which permits easy setting of a long flexible label tape in the casing and automatic turning back of said label tape at the carrier tape turnback part.

Another object of the present invention is to provide a labeler in which the label tape extending inside the casing will not be shifted by a force applied to the carrier strip in the carrier strip feeding direction when a label is to be applied onto an article.

SUMMARY OF THE INVENTION

The labeler of the present invention is adapted so that a slit extends through a side wall of the casing from the tape holder to the bottom cover. The bottom cover is pivoted on its base end part at a position spaced from the end of said slit adjacent the feed drum. The lower opening of said slit is exposed and the label receiving surface is adjacent the exposed end of the slit when the bottom cover is opened. The feed drum is provided with the carrier strip feed-out mechanism for feeding out the carrier strip from the casing in cooperation with said drum, and the carrier strip can be set for automatic feeding by inserting the carrier strip into the casing after passing it along the lower surface of the bottom cover when the cover is closed.

For setting the label tape in the labeler according to the present invention, the bottom cover is opened and an end of the slit provided on the side wall of the casing in a vertical direction is exposed. The label tape is drawn out from the tape holder and inserted into the slit from the lateral side of the casing and is delivered past the end of the bottom cover beyond the front side, then the bottom cover is closed and the carrier strip is inserted into the carrier strip feed-out mechanism in the casing. Thus, the label tape can be extended in the feed passage and the carrier strip of said label tape is engaged with the feed drum.

Moreover, the labeler according to the present invention is provided with a label control means, which makes the label tape stationary, such as, for example, an impression member which depresses the label tape against the bottom cover while said label tape extended inside the casing is not fed by the feed drum, and the label tape is kept stationary when a label is to be applied onto an article by this impression member.

DETAILED DESCRIPTION OF THE INVENTION

Figure 1:
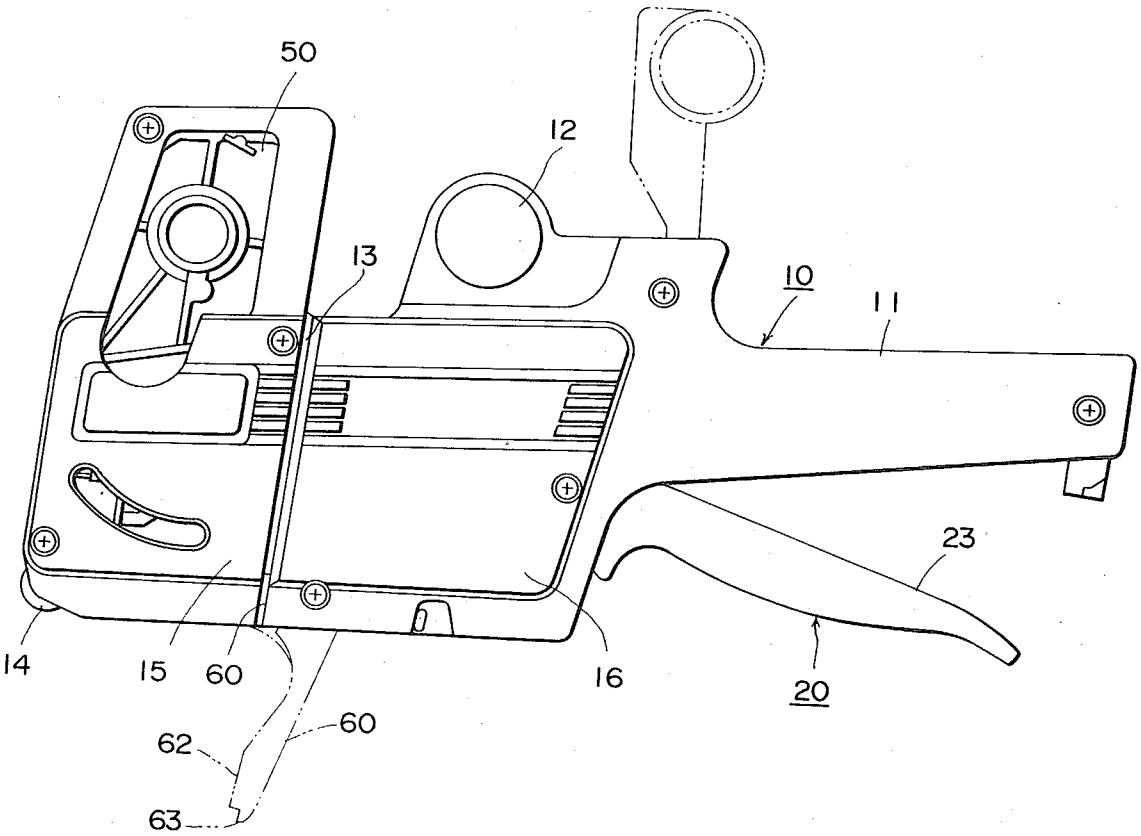
FIG. 1 is a side view of the labeler according to the present invention.
Figure 2:
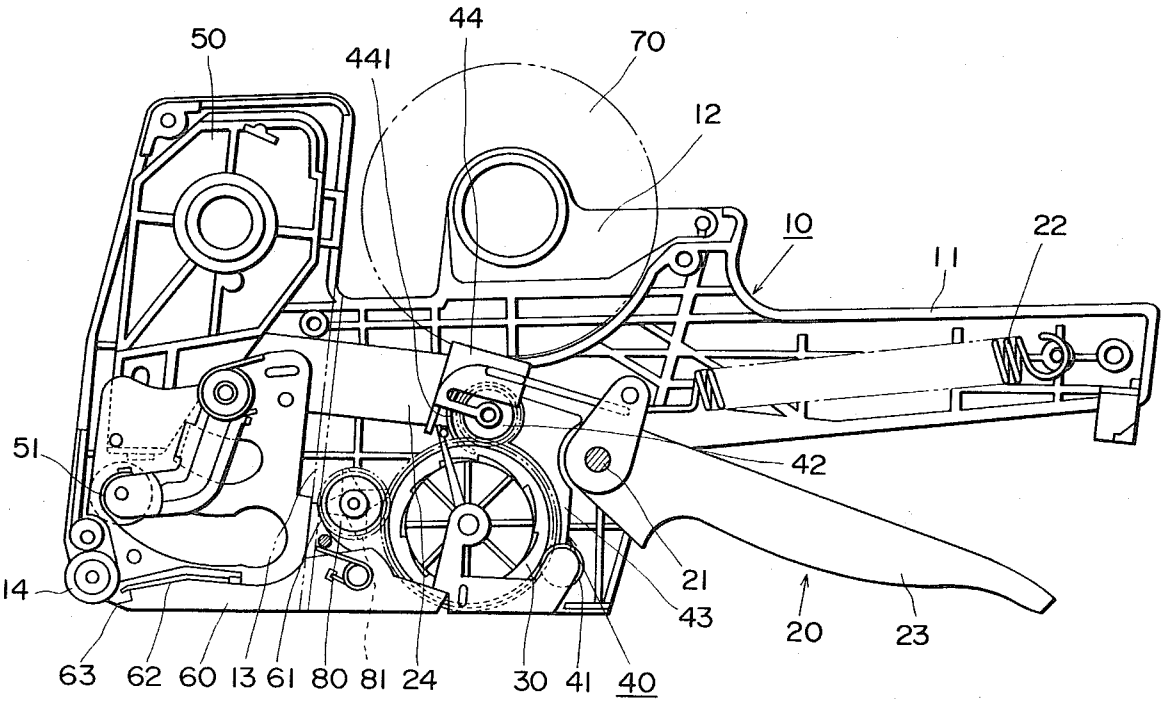
FIG. 2 is a side view showing the interior of said labeler.

Referring to FIGS. 1 and 2, there is shown a labeler as the most probable embodiment of the present invention.

The labeler according to the present invention is provided with a casing 10 having a handle 11 extending therefrom at its rear part, a drive mechanism 20 on this casing 10, a feed drum 30 provided in the casing 10 and driven by said drive mechanism 20, a carrier strip feed-out mechanism 40 for feeding out the carrier strip in cooperation with this feed drum, and a printer unit 50 which is driven by said mechanism, and a bottom cover 60 which is provided on the underside of said casing 10.

Construction of Casing

Said casing 10 is provided, in addition to the handle 11, with a label tape holder 12 located at the upper part of the casing, a slit 13 in one side wall, generally the right hand side wall of the casing 10, and a label applicator such as a depression roller 14 provided at the front end part of the casing.

Said label tape holder 12 is constructed to be pivotally movable upwardly as shown in FIG. 1. The label tape holder 12 is operated to be upright as shown with a broken line in FIG. 1 when setting the label tape 70 on the label tape holder 12 and to be returned to the home position after the label tape 70 has been set as shown with a solid line in FIG. 1, and the label tape 70 can be held between both side walls of the casing without falling off after the label tape holder 12 has been returned to the home position.

Said slit 13 extends from a position near said label tape holder 12 to a lower position thereby completely separating a side wall of the casing 10 into a front end part 15 and a rear end part 16.

Construction of Drive Mechanism

Said drive mechanism 20 has a lever 23 which is pivoted at one point 21 and is biased away from the handle 11 by the reset spring 22 as shown in FIG. 2 and is manually operated to be moved toward the handle. The operating part 24 extends in the casing from the lever 23 and a driving member such as a rack gear is provided on said operating part 24. The drive mechanism 20 is constructed so that said rack gear 25 drives the feed drum 30 and said operating part 24 drives the printer unit 50, and this construction is same as the conventionally known labeler.

Construction of Feed Drum

Figure 3:
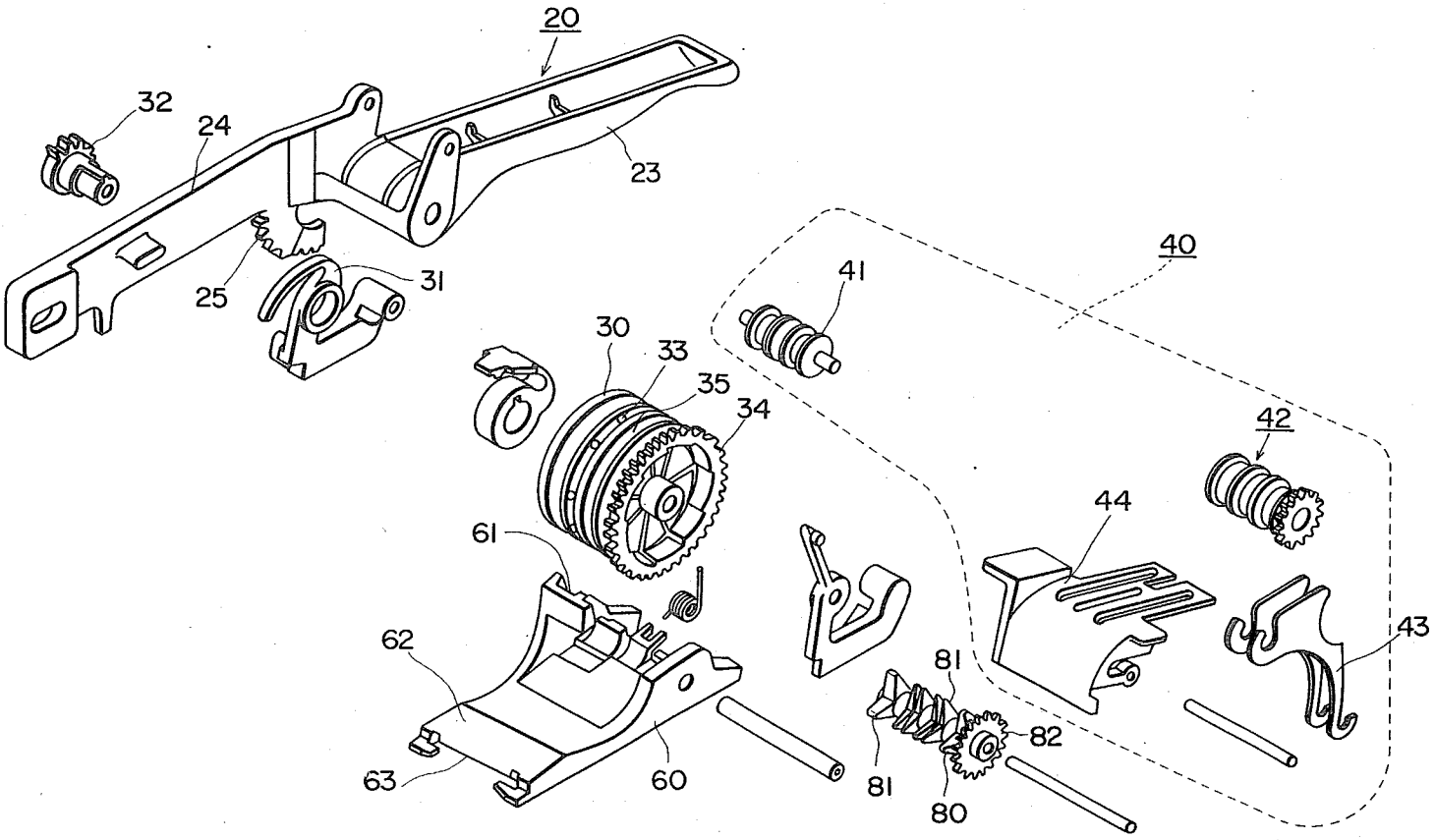
FIG. 3 is a perspective view of principal components of said labeler.

Said feed drum 30 incorporates a one-way clutch 31 as shown in FIG. 3. This feed drum 30 is constructed so that the gear 32 coupled to this one-way clutch 31 is engaged with said rack gear 25 such that the feed drum 30 is not driven by movement of the lever 23 toward the handle by is driven to a certain specified angle by a resetting motion of the lever 23.

Said feed drum 30 is provided with a projection 33 for engaging the carrier strip 71 of the label tape 70, a drive gear 34 for driving the carrier strip feed mechanism 40, etc. and a groove 35 extending in the peripheral direction, and this drive gear 34 is coaxially mounted with the feed drum 30.

The construction of this type of feed drum is the same as that of the conventionally known labeler.

Construction of Carrier Feed-out Mechanism

Said carrier strip feed-out mechanism 40 has a label tape feed-in roller 41 which is forcibly depressed onto said feed drum 30, a feed-out roller 42 which is engaged with said drive gear 34, a first guide member 43 arranged between rollers 41 and 42 and the second guide member 44 at a discharging side to which said feed roller 42 is pivotally secured. Said feed-in and feed-out rollers 41 and 42 are rotated by the feed drum 30 and the drive gear 34 to forward the carrier strip 71 in the feed-out direction when the carrier strip 71 extending along the lower surface of said bottom cover 60 is inserted into the casing 10.

In the embodiment, said carrier strip 71 is fed out by the feed-out roller 42 from an opening between the handle 11 of the casing 10 and the lever 23. Thus this construction can be made as desired as that of conventionally known labelers.

To ensure complete feeding out of this carrier strip 71, in the embodiment, said second guide member 44 is provided with a stripper 441 which is plunged into the groove 35 of the feed drum 30 as shown in FIG. 2 to separate the carrier strip 71 from the feed drum 30.

Construction of Printer Unit

Said printer unit 50 is mounted on the operating part 24 of said drive mechanism 20 and lowers toward the label receiving surface 62 provided on said bottom cover 60 when the lever 23 is pivotally moved to approach to the handle 11, thus printing on the label 72 on the label receiving surface 62. Generally, the printer unit 50 has an ink applying mechanism such as, for example, an ink roller 51 which applies ink onto type faces when it is lowered.

The construction of this type of printer unit 50 is same as that of conventionally known labelers and some types of labelers do not require the printer unit.

Construction of Bottom Cover

Said bottom cover 60 is constructed so that it is pivotally secured with its base end part at the feed drum side away from said slit 13, a part of the bottom cover which is housed inside a casing 10 has the label tape receiving surface 61 opposed to a pressure contacting part 81 of an impression member 80 described below and a label receiving surface 62 is provided just below said printer unit 50, and the swing end following this label receiving surface 62 is formed at the carrier strip turnback part 63.

Said impression member 80 is provided with a gear 82 which engages said drive gear 34 and, for example, has a cross-shaped multi-edged pressure contacting part 81 which comes in pressure contact with said label tape receiving surface 61 to urge the label tape 70 into contact with the label tape receiving surface 61 with the tip of this pressure contacting part 81.

The relationship of said tape receiving surface 61 and the pressure contact part 81 of said impression member 80 is set so that the pressure contact part 81 is moved away from the tape receiving surface 61 when the feed drum 30 is rotated and the pressure contact part 81 depresses the label tape 70 onto the label tape receiving surface 61 when the feed drum 30 is stopped, and thus the label tape 70 is prevented from drifting whenever a label 72 is stuck to an article.

Another construction can be selected as a label tape control means as described above. For example, a spring member can be used which is adapted to release the label tape in conjunction with the drive mechanism 20 only while the feed drum 30 is operating.

The labeler according to the present invention is constructed as described above. The roll-shaped label tape 70 is loaded by pivotally moving the tape holder 12 to the upright position as shown with the broken line in FIG. 1 and FIG. 4 and then is drawn out downwardly after opening the bottom cover 60. Then the free end of said label tape 70 is drawn out and inserted into said slit 13 from the lateral side and is pulled downwardly beyond the free end of the bottom cover 60 as shown with the solid line in FIG. 4.

Figure 4:
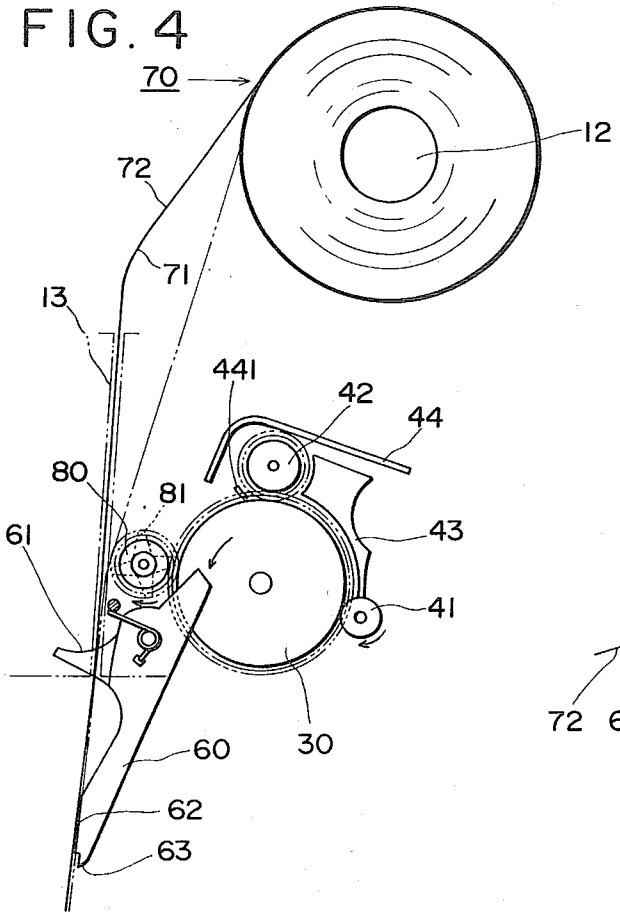

Thus, said label tape 70 is housed in the casing 10 through the slit 13 and extends into the casing while keeping contact with the impression member 80 as shown with a broken line in FIG. 4, and the lower end is suspended from the bottom cover 60 to the lower side.

Figure 5:
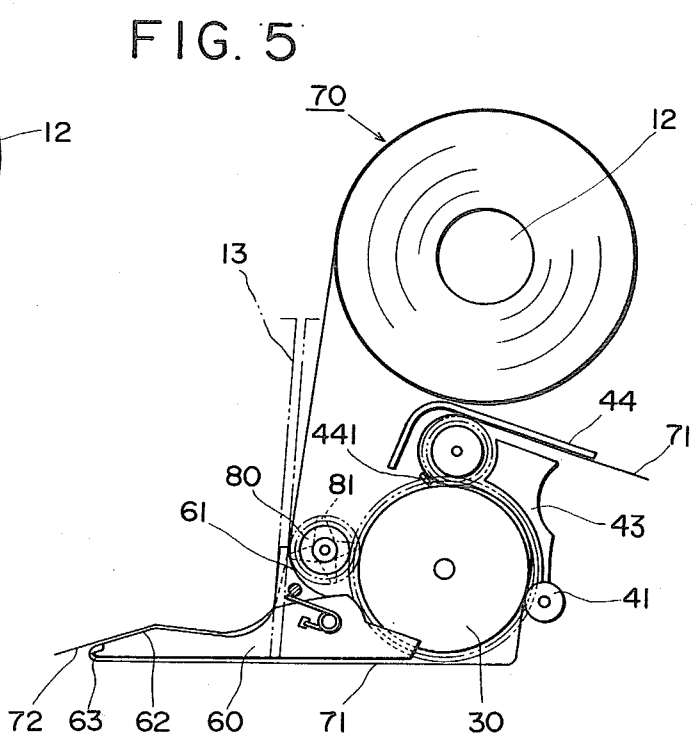
FIGS. 4 and 5 are respectively a simplified illustration of the present invention showing the position of the label tape when it is to be loaded on said labeler and a simplified illustration of the present invention after the label tape is located.

When said bottom cover 60 is closed as shown in FIGS. 2 and 5 and the tape holder 12 is returned to the home position, the label tape 70 is turned back and the carrier strip turnback part 63 and the labels 72, before extending around this carrier strip turnback part 63 with the carrier strip, are peeled from the carrir strip 71 and thus the carrier strip 71 is exposed. When the carrier strip 71 extends along the lower surface of the bottom cover 60 and inserted between the feed drum 30 and the feed-in roller 41, the carrier strip 71 is engaged with the projection 33 of the feed drum 30.

Accordingly, after that, the carrier strip 71 is intermittently fed by reciprocating the lever 23 and the label 72 can be peeled from the carrier strip 71 at the carrier strip turnback part 63 and forwarded as shown in FIG. 5.

What is claimed is:

1. A manually-operated labeler for dispensing labels from a carrier strip to which said labels adhere, said labeler comprising:

a casing having two side walls which together define an upper part, a bottom part, a front end part, and a rear end part of said casing;

a tape holder fixed to said upper part of said casing for holding a roll of the carrier strip;

a handle extending from said rear end part of said casing;

a lever pivotally mounted in and extending from said casing at said rear end part of said casing, said lever being pivotable toward and away from said handle;

a feed drum within said casing over which the carrier strip extends from the roll thereof, said feed drum operatively connected to said lever for being driven intermittently thereby when said lever is pivoted toward and away from said handle for feeding predetermined lengths of the carrier strip intermittently from the roll;

a bottom cover pivotally mounted to said casing so as to be pivotable toward and away from said casing for opening and closing over said bottom part of said casing, said bottom cover extending along said bottom part of said casing to a free end thereof adjacent said front end part of said casing when said bottom cover is closed, the carrier strip extending from the roll and through said casing and around said free end of said bottom cover before extending over said feed drum in said casing;

a carrier strip feed-out mechanism within said casing for directing the carrier strip out of said casing after the carrier strip extends around said feed drum; and said casing having a slit extending through one of said side walls from said upper part to a location at said bottom part past which said bottom cover extends when said bottom cover is closed, said location also being spaced from a part of said casing at which the bottom cover is pivotally mounted, said slit for allowing the carrier strip extending from the roll to be manually feed therethrough into the casing so as to extend through said casing from said upper part to said bottom part when said bottom cover is pivoted away from the bottom of said casing.

2. A labeler as claimed in claim 1, and further comprising a printer unit within said casing for printing an image on the labels adhering to the carrier strip extending through said casing before the carrier strip extends around said free end of said bottom cover.

3. A labeler as claimed in claim 1, wherein said carrier strip feed-out mechanism directs the carrier strip out of said casing at said rear end part of said casing between said lever and said handle.

4. A manually-operated labeler for dispensing labels from a carrier strip to which said labels adhere, said labeler comprising:

a casing having two side walls which together define an upper part, a bottom part, a front end part and a rear end part of said casing;

a tape holder fixed to said upper part of said casing for holding a roll of the carrier strip;

a handle extending from said rear end part of said casing;

a lever pivotally mounted in and extending from said casing at said rear end part of said casing, said lever being pivotable toward and away from said handle;

a feed drum within said casing around which the carrier strip extends from the roll thereof, said feed drum operatively connected to said lever for being driven intermittently thereby when said lever is manually pivoted toward and away from said handle for feeding predetermined lengths of the carrier strip intermittently from the roll;

a bottom cover pivotally mounted at one end thereof to said casing so as to be pivotable toward and away from said casing for opening and closing over said bottom part of said casing, said bottom cover extending along said bottom part of said casing to a free end thereof adjacent said front end part of said casing when said bottom cover is closed, the carrier strip extending from the roll and through said casing and around said free end of said bottom cover before extending around said feed drum in said casing, said bottom cover having a label tape receiving surface extending between said side walls of said casing when said bottom cover is closed, the carrier strip extending over said label tape receiving surface when said bottom cover is closed before extending over said free end of said bottom cover;

a carrier strip feed out mechanism within said casing for directing the carrier strip out of said casing after the carrier strip extends around said feed drum; and a label tape control means within said casing and adjacent the carrier strip extending through said casing, said label tape control means operatively connected to said feed drum for clamping the carrier strip against said label tape receiving surface during the dwell period of said feed drum when said feed drum is driven intermittently, said label tape control means releasing the carrier strip from against said label tape receiving surface while said feed drum feeds the carrier strip when said feed drum is driven intermittently.

5. A labeler as claimed in claim 4, wherein said label tape control means comprises an impression member rotatably mounted within said casing opposite from said label tape receiving surface when said bottom cover is closed, the carrier strip extending between said label tape receiving surface and said impression member, said impression member being rotated by said feed drum.

6. A labeler as claimed in claim 5, wherein said impression member is cross-shaped and is rotatably mounted to said casing at the center thereof so as to have projections defining the cross-shape thereof extending radially outwards from said center, said projections successively clamping the carrier strip against said label tape receiving surface as said impression member is rotated by said feed drum.

7. A labeler as claimed in claim 4, and further comprising a printer unit within said casing for printing an image on the labels adhering to the carrier strip extending through said casing before the carrier strip extends around said free end of said bottom cover.

8. A labeler as claimed in claim 4, wherein said carrier strip feed-out mechanism directs the carrier strip out of said casing at said rear end part of said casing between said lever and said handle.

9. A manually-operated labeler for dispensing labels from a carrier strip to which said labels adhere, said labeler comprising:

a casing having two side walls which together define an upper part, a bottom part, a front end part and a rear end part of said casing;

a tape holder fixed to said upper part of said casing for holding a roll of the carrier strip;

a handle extending from said rear end part of said casing;

a lever pivotally mounted in and extending from said casing at said rear end part of said casing, said lever being pivotable toward and away from said handle;

a feed drum within said casing around which the carrier strip extends from the roller thereof, said feed drum operatively connected to said lever for being driven intermittently thereby when said lever is pivoted toward and away from said handle for feeding predetermined lengths of the carrier strip intermittently from the roll;

a bottom cover pivotally mounted to said casing so as to be pivotable toward and away from said casing for opening and closing over said bottom part of said casing, said bottom cover extending along said bottom part of said casing to a free end thereof adjacent said front end part of said casing when said bottom cover is closed, the carrier strip extending from the roll and through said casing and around said free end of said bottom cover before extending over said feed drum in said casing, said bottom cover having a label tape receiving surface extending between said side walls of said casing when said bottom cover is closed, the carrier strip extending over said label tape receiving surface when said bottom cover is closed before extending around the free end of said bottom cover;

a carrier strip feed-out mechanism within said casing for directing the carrier strip out of said casing after the carrier strip extends around said feed drum;

a label tape control means within said casing and adjacent the carrier strip extending through said casing, said label tape control means operatively connected to said feed drum for clamping the carrier strip against said label tape receiving surface during the dwell period of said feed drum when said feed drum is driven intermittently, said label tape control means releasing the carrier strip from against said label tape receiving surface while said feed drum feeds the carrier strip when said feed drum is driven intermittently; and said casing having a slit extending through one of said side walls from said upper part to a location on said bottom part past which said bottom cover extends when said bottom cover is closed, said location also being spaced from the part of said casing at which the bottom cover is pivotally mounted, said slit for allowing the carrier strip extending from the roll to be manually feed therethrough into the casing so as to extend through said casing from said upper part to said bottom part when said bottom cover is pivoted away from the bottom of said casing.

10. A labeler as claimed in claim 9, and further comprising a printer unit within said casing for printing an image on the labels adhering to the carrier strip extending through said casing before the carrier strip extends around said free end of said bottom cover.

11. A labeler as claimed in claim 9, wherein said carrier strip feed-out mechanism directs the carrier strip out of said casing at said rear end part of said casing between said lever and said handle.

12. A labeler as claimed in claim 9.

wherein said label tape control means comprises an impression member rotatably mounted within said casing opposite from said label tape receiving surface when said bottom cover is closed, the carrier strip extending between said label tape receiving surface and said impression member, said impression member being rotated by said feed drum.

13. A labeler as claimed in claim 12, wherein said impression member is cross-shaped and is rotatably mounted to said casing at the center thereof so as to have projections defining the cross-shape thereof extending radially outwards from said center, said projections successively clamping the carrier strip against said label tape receiving surface as said compression member is rotated by said feed drum.

14. A labeler as claimed in claim 12, and further comprising a printer unit within said casing for printing an image on the labels adhering to the carrier strip extending through said casing before the carrier strip extends around said free end of said bottom cover.

15. A labeler as claimed in claims 12, wherein said carrier strip feed-out mechanism directs the carrier strip out of said casing at said rear end part of said casing between said lever and said handle.

* * * * *